US007637763B1

(12) United States Patent
Peng

(10) Patent No.: US 7,637,763 B1
(45) Date of Patent: Dec. 29, 2009

(54) CONNECTOR FOR FLEXIBLE PRINTED CIRCUIT

(75) Inventor: Yung-Chi Peng, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/192,357

(22) Filed: Aug. 15, 2008

(51) Int. Cl.
*H01R 13/15* (2006.01)

(52) U.S. Cl. ..... 439/260; 439/492

(58) Field of Classification Search ..... 439/260, 439/492, 495

See application file for complete search history.

(56) References Cited

U.S. PATENT DOCUMENTS 6,203,345 B1 * 3/2001 Roque et al. ..... 439/260
6,254,406 B1 * 7/2001 Chiu et al. ..... 439/142
7,063,559 B2 * 6/2006 Wang et al. ..... 439/495
7,083,464 B2 * 8/2006 Liu et al. ..... 439/495
7,086,893 B2 * 8/2006 Liu et al. ..... 439/495
7,291,039 B2 * 11/2007 Shin ..... 439/495
7,399,193 B1 * 7/2008 Ho et al. ..... 439/260

* cited by examiner

*Primary Examiner*—Thanh-Tam T Le
(74) *Attorney, Agent, or Firm*—WPAT, P.C.; Anthony King

(57) ABSTRACT

A connector includes an insulating housing defining a mouth in a rear thereof, a plurality of terminals disposed in the insulating housing, an actuator rotatably mounted to the mouth of the insulating housing and defining two pilot portions rotatably mounted in two opposite ends of the insulating housing respectively, and at least two support members positioned in the two opposite ends of the insulating housing respectively. Each of the support members defines an elastic portion, wherein the elastic portions abut against the corresponding pilot portions of the actuator when the actuator is closed.

5 Claims, 5 Drawing Sheets

CONNECTOR FOR FLEXIBLE PRINTED CIRCUIT

BACKGROUND OF THE INVENTION

1. Field of the Invention

The present invention generally relates to an electrical connector, and more particularly to an electrical connector for a flexible printed circuit (FPC hereinafter for simplification).

2. The Related Art

A traditional FPC connector includes an insulating housing, a plurality of terminals disposed in the insulating housing and an actuator. The actuator is rotatably mounted in the insulating housing and defines two pilot portions rotatably mounted in two opposite ends of the insulating housing respectively so that the actuator can be opened or closed freely. After inserting a flexible printed circuit into the FPC connector, the actuator can stably pivot from an open position to a closed position. However, for a distance always exists between the pilot portions of the actuator and the insulating housing, while at the closed position, the actuator is apt to move at random under shaking to cause that the flexible printed circuit and the terminals electrically contact each other unsteadily. Therefore, an FPC connector capable of making the actuator closed firmly is required.

SUMMARY OF THE INVENTION

An object of the present invention is to provide an FPC connector, which can make an actuator closed firmly.

The FPC connector includes an insulating housing defining a mouth in a rear thereof, a plurality of terminals disposed in the insulating housing, the actuator rotatably mounted to the mouth of the insulating housing and defining two pilot portions rotatably mounted in two opposite ends of the insulating housing respectively, and at least two support members positioned in the two opposite ends of the insulating housing respectively. Each of the support members defines an elastic portion, wherein the elastic portions abut against the corresponding pilot portions of the actuator when the actuator is closed.

As described above, while the actuator is at a closed position, the elastic portions of the support members abut against the corresponding pilot portions of the actuator to prevent the actuator from moving at random so that the actuator can be firmly closed even though the FPC connector is shaken.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
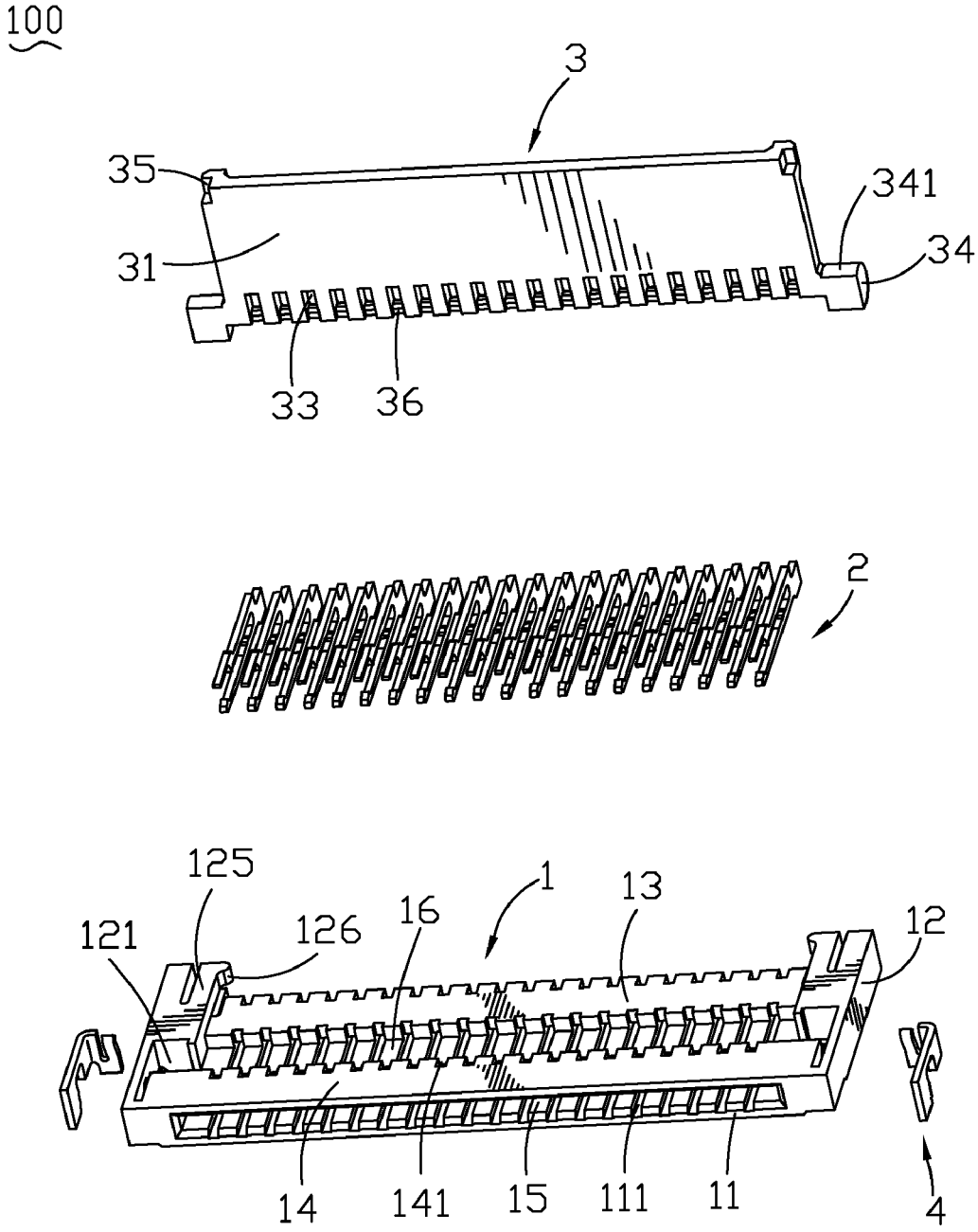
FIG. 1 is an exploded perspective view of an FPC connector in accordance with the present invention.

With reference to FIG. 1, an FPC connector 100 according to the present invention includes an insulating housing 1, a plurality of terminals 2, an actuator 3 and a pair of support members 4.

Figure 4:
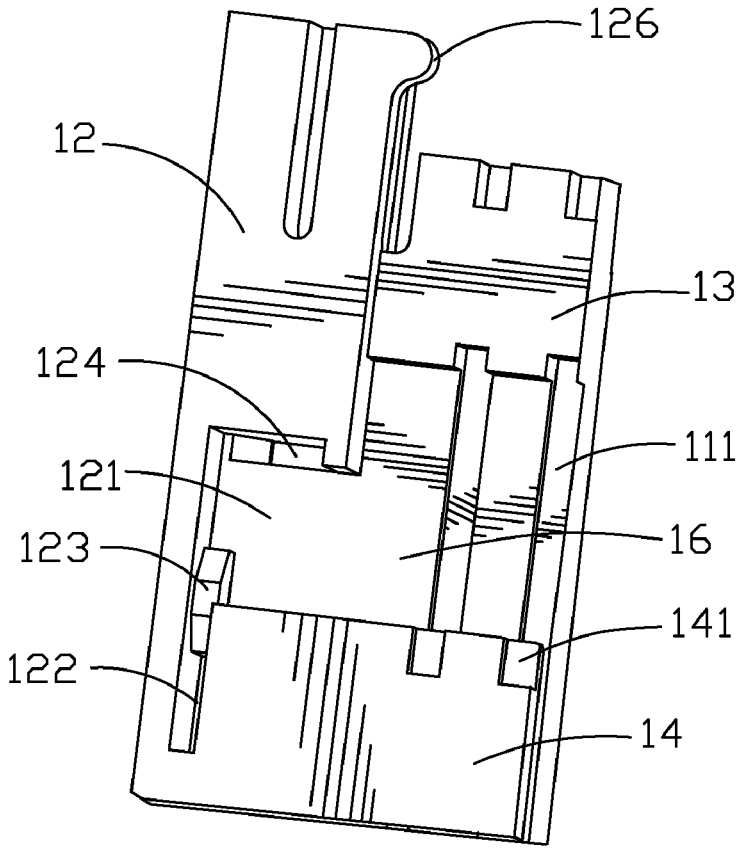
FIG. 4 is a partial perspective view of an insulating housing of the FPC connector of FIG. 1.

Referring to FIG. 1 and FIG. 4, the insulating housing 1 is of rectangular shape and has a bottom wall 11, two sidewalls 12 and a rear wall 13 lower than the sidewalls 12. A top plate 14 extends transversely to connect the top of the sidewalls 12 at front. Accordingly, a mouth 16 is defined in a rear of the insulating housing 1 and formed among the sidewalls 12, the rear wall 13 and the top plate 14. An inserting window 15 is defined in a front of the insulating housing 1 and surrounded among the bottom wall 11, the top plate 14 and the sidewalls 12. The inserting window 15 communicates with the mouth 16. A top of the bottom wall 11 defines a plurality of first cavities 111 arranged at regular intervals along a longwise direction thereof. The first cavities 111 extend from front to rear and pass through the rear wall 13. A rear of a top of the top plate 14 defines a plurality of second cavities 141 corresponding to the respective first cavities 111. The sidewalls 12 define two facing receiving fillisters 121 at top communicating with the mouth 16 and adjacent to the top plate 14. A side of the receiving fillister 121 apart from the mouth 16 extends forward and then penetrates through a bottom of the sidewall 12 to form a first fixing slot 122. A fixing block 123 is defined across the junction of the receiving fillister 121 and the first fixing slot 122. A rear side of the receiving fillister 121 extends rearward and penetrates through the bottom of the sidewall 12 to form a second fixing slot 124 apart from the mouth 16. A rear of each of the sidewalls 12 defines an elastic bar 125 at top thereof, the elastic bar 125 has a front end connected with the sidewall 12 and a rear end extending rearward freely. The two elastic bars 125 face each other and the rear ends thereof protrude toward each other to form two facing locking projections 126.

Figure 5:
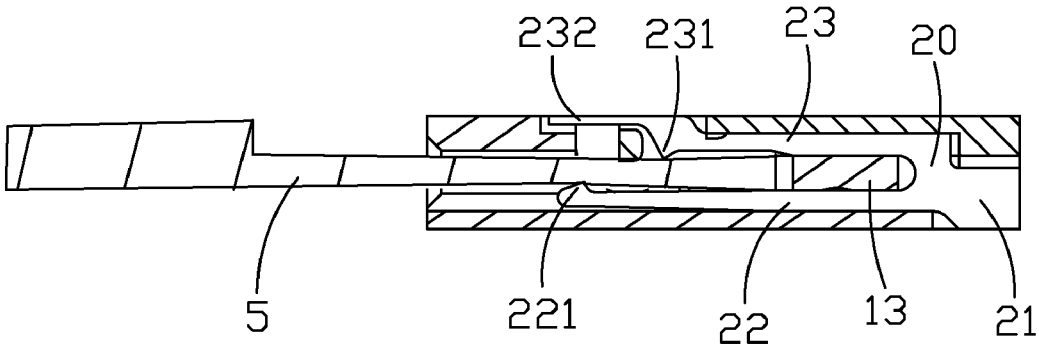
FIG. 5 is a longitudinal cross-sectional view of the FPC connector of FIG. 3, wherein a flexible printed circuit is inserted therein.

Referring to FIG. 5, each of the terminals 2 has a base prop 20. A top of the base prop 20 extends forward to form an upper arm 23. A free end of the upper arm 23 protrudes downward to form a barb 231, and bends upward and then extends forward to form a bearing arm 232. A bottom of the base prop 20 extends forward to form a lower arm 22 and extends rearward to form a soldering foot 21. A free end of the lower arm 22 protrudes upward to form a contact portion 221.

Figure 2:
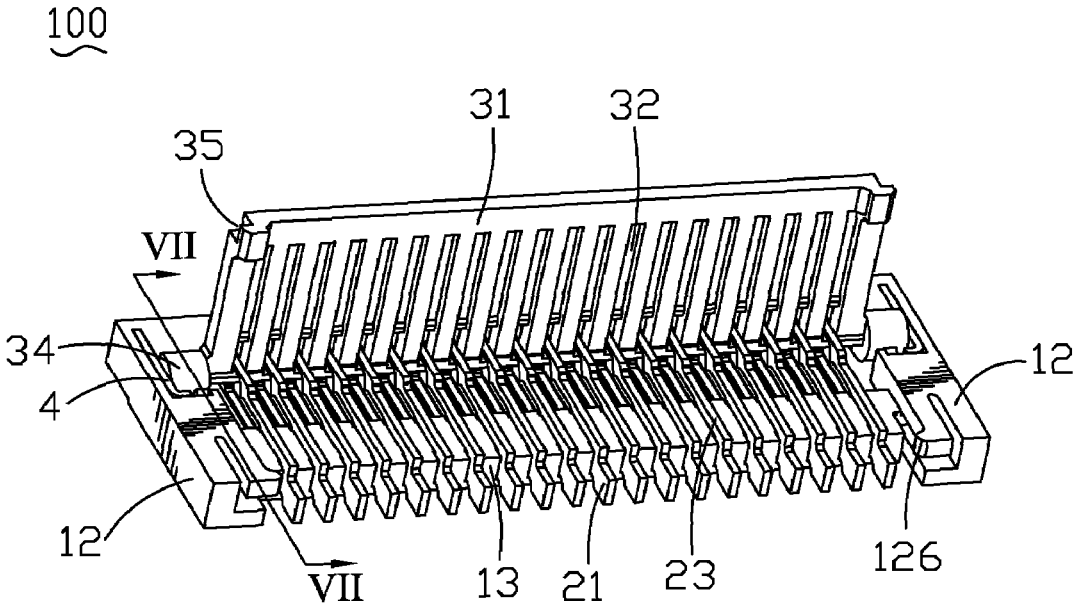
FIG. 2 is a perspective view of the FPC connector of FIG. 1, wherein an actuator of the FPC connector is opened.
Figure 3:
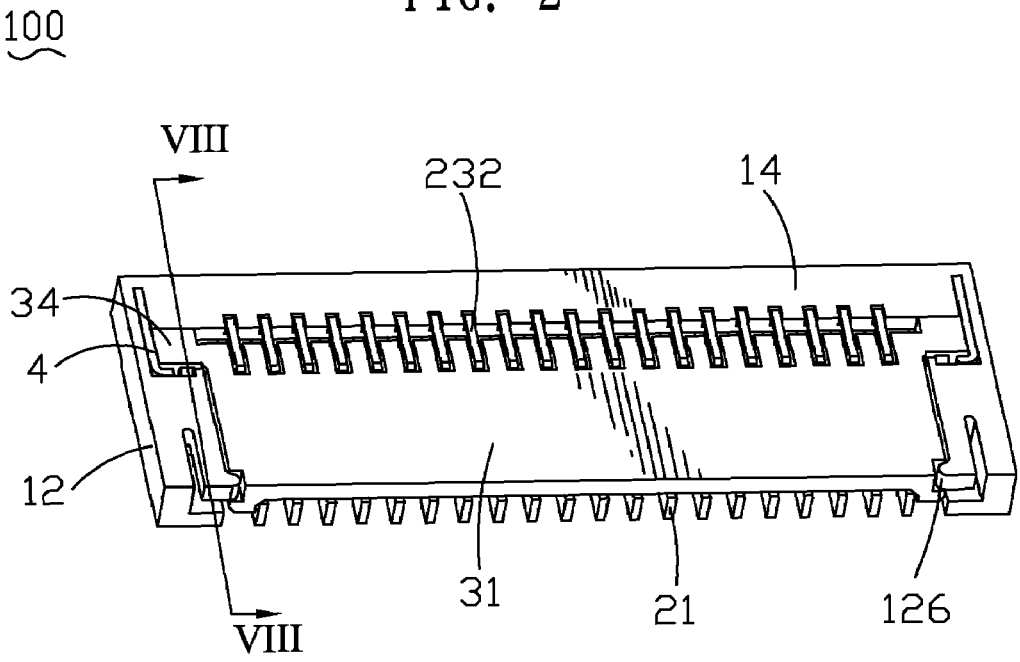
FIG. 3 is a perspective view of the FPC connector of FIG. 1, wherein the actuator of the FPC connector is closed.

Referring to FIG. 1 and FIG. 2, the actuator 3 is substantially rectangular and has a flat base board 31. A bottom of the base board 31 defines a plurality of locating grooves 32 arranged at regular intervals along a longwise direction thereof and corresponding to the first cavities 111. A front of the base board 31 defines a plurality of locating holes 33 penetrating from top to bottom and arranged at regular intervals along the longwise direction thereof. The locating holes 33 respectively communicate with the corresponding locating grooves 32. Accordingly, a plurality of prop beams 36 are formed in front of the locating holes 33 at bottom. Two ends of the front of the base board 31 respectively protrude sideward to form a pilot portion 34 corresponding to the respective receiving fillister 121 of the insulating housing 1 and having a substantially semi-circular longitudinal cross-section and an arc surface 341 at bottom. Two ends of a rear of the base board 31 respectively define a locking trough 35 matching with the corresponding locking projection 126 of the insulating housing 1.

Figure 6:
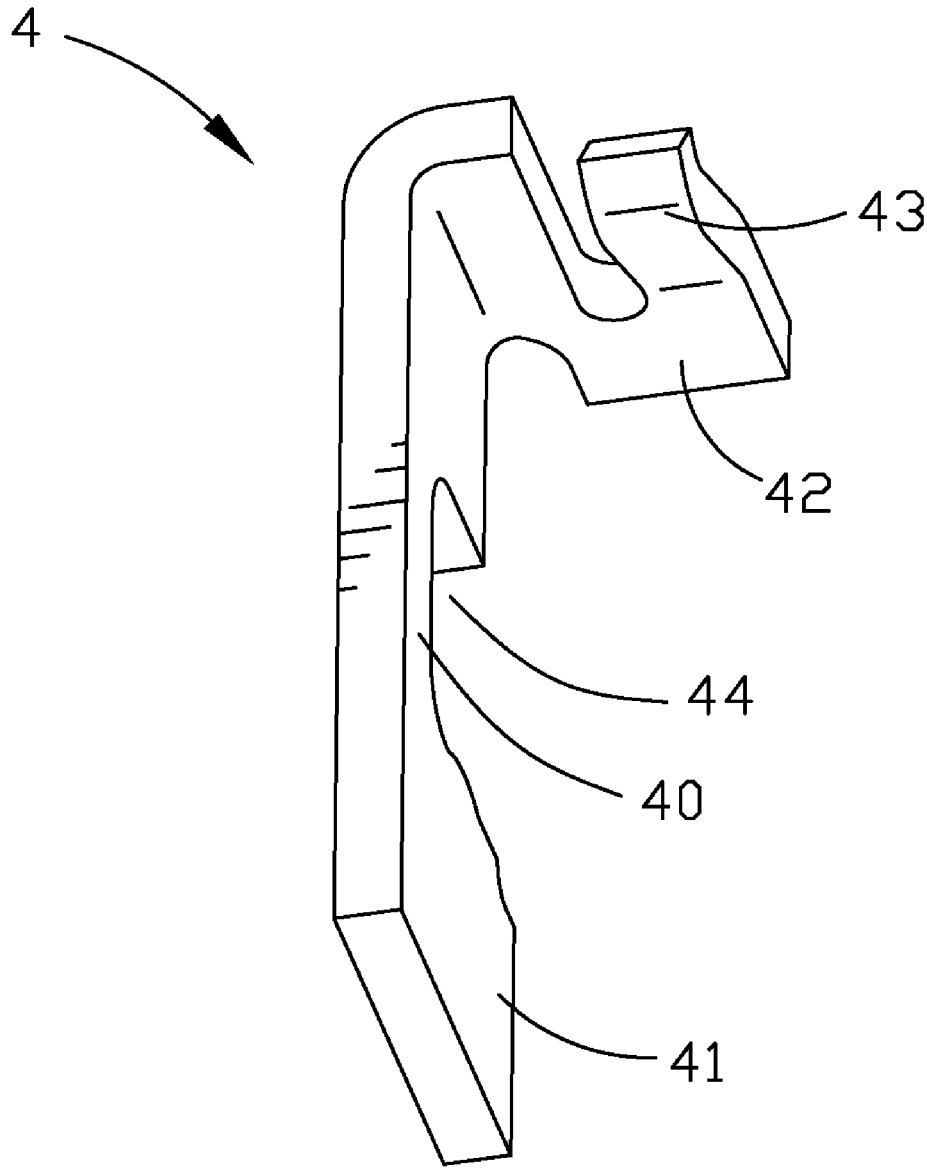
FIG. 6 is a perspective view of a support member of the FPC connector of FIG. 1.
Figure 7:
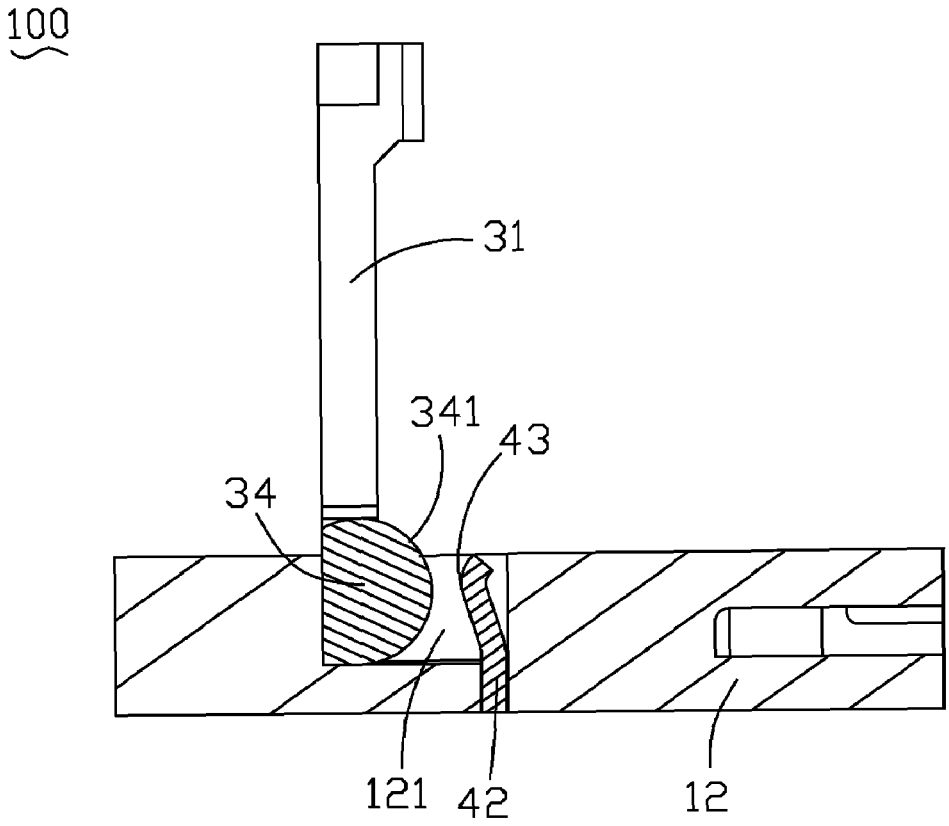
FIG. 7 is a cross-sectional view of the FPC connector along line VII-VII of FIG. 2.
Figure 8:
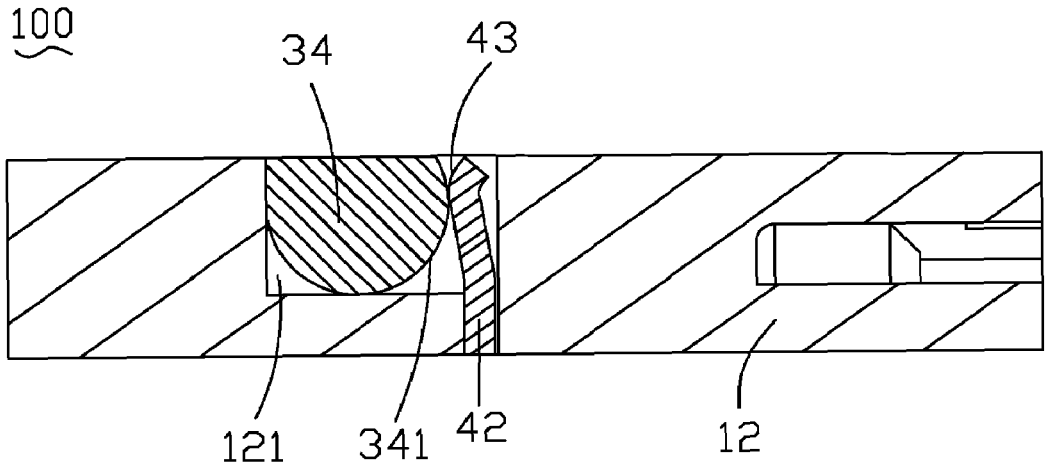
FIG. 8 is a cross-sectional view of the FPC connector along line VIII-VIII of FIG. 3.

Referring to FIG. 6, each of the support members 4 has a base portion 40 extending longitudinally. A front of the base portion 40 extends downward to form a first fixing portion 41. A bottom of the base portion 40 defines a receiving gap 44 tallying with the fixing block 123 of the insulating housing 1 and adjacent to the first fixing portion 41. A rear end of the base portion 40 bends sideward and then extends downward to form a second fixing portion 42. The second fixing portion 42 defines an elastic portion 43 at top thereof, the elastic portion 43 has a bottom end connected with the second fixing portion 42 and a top end protruding forward freely.

Referring to FIGS. 2, 3, 5, 7 and 8, in assembly, the support member 4 is positioned in the corresponding sidewall 12. The first fixing portion 41 is inserted in the first fixing slot 122 and the fixing block 123 buckles into the receiving gap 44. The second fixing portion 42 is inserted in the second fixing slot 124 and the elastic portion 43 stretches into the receiving fillister 121. The actuator 3 is rotatably mounted to the mouth 16 of the insulating housing 1. The pilot portions 34 of the actuator 3 are rotatably mounted in the corresponding receiving fillisters 121 and located in front of the elastic portions 43 of the corresponding support members 4. The terminals 2 are assembled in the insulating housing 1. The base prop 20 is disposed in a rear of the rear wall 13 and the lower arm 22 is received in the corresponding first cavity 111. The upper arm 23 is mounted on the rear wall 13 and the bearing arm 232 passes through the corresponding locating hole 33 of the actuator 3 to insert into the corresponding second cavity 141. The prop beams 36 of the actuator 3 are located under the corresponding bearing arms 232 to prevent the actuator 3 from falling off the insulating housing 1 when the actuator 3 is opened or closed. The soldering foots 21 of the terminals 2 are located behind the rear wall 13 and soldered to a circuit board (not shown).

In use, the actuator 3 is opened forward, the arc surfaces 341 of the pilot portions 34 are apart from the elastic portions 43 of the corresponding support members 4. A flexible printed circuit 5 is inserted rearward between the upper arms 23 and the lower arms 22 of the terminals 2 along the inserting window 15 and contacts the contact portions 221 of the terminals 2. Then the actuator 3 is closed rearward. The upper arms 23 of the terminals 2 are received in the corresponding locating grooves 32 of the actuator 3 and the barbs 231 tightly abut against a top of the flexible printed circuit 5. The locking projections 126 buckle into the corresponding locking troughs 35. The elastic portions 43 of the support members 4 tightly abut forward against the corresponding arc surfaces 341 of the pilot portions 34 to prevent the actuator 3 from moving at random under shaking so as to ensure that the actuator 3 is closed firmly and further ensure that the terminals 2 electrically contact the flexible printed circuit 5 steadily.

As described above, while the actuator 3 is at a closed position, the elastic portions 43 of the support members 4 tightly abut forward against the arc surfaces 341 of the corresponding pilot portions 34 of the actuator 3 to prevent the actuator 3 from moving at random so that the actuator 3 can be firmly closed even though the FPC connector 100 is shaken so as to ensure that the terminals 2 electrically contact the flexible printed circuit 5 steadily.

What is claimed is:

1. A connector adapted for a flexible printed circuit, comprising:

an insulating housing defining a mouth in a rear thereof;

a plurality of terminals disposed in the insulating housing;

an actuator rotatably mounted to the mouth of the insulating housing, the actuator defining two pilot portions rotatably mounted in two opposite ends of the insulating housing respectively; and at least two support members positioned in the two opposite ends of the insulating housing respectively, each of the support members defining an elastic portion, wherein the elastic portions abut against the corresponding pilot portions of the actuator when the actuator is closed;

wherein the two ends of the insulating housing respectively defines a receiving fillister communicating with the mouth and facing each other, one side of the receiving fillister extends forward and downward to form a first fixing slot, a rear side of the receiving fillister extends rearward and downward to form a second fixing slot;

wherein each of the support members has a base portion extending longitudinally, a front of the base portion extends downward to form a first fixing portion inserted in the first fixing slot, a rear end of the base portion bends sideward and then extends downward to form a second fixing portion inserted in the second fixing slot, the elastic portion has a bottom end connected with the second fixing portion and a top end protruding forward freely to stretch into the receiving fillister.

2. The connector as claimed in claim 1, wherein the insulating housing defines two fixing blocks respectively located across the junction of the receiving fillisters and the corresponding first fixing slots, a bottom of each of the base portions defines a receiving gap buckling with the corresponding fixing block.

3. The connector as claimed in claim 1, wherein the pilot portions of the actuator are rotatably mounted in the corresponding receiving fillisters in front of the elastic portions of the corresponding support members.

4. The connector as claimed in claim 1, wherein the insulating housing defines an inserting window in a front thereof communicating with the mouth for guiding the flexible printed circuit to be inserted in the connector.

5. The connector as claimed in claim 1, wherein the two ends of the insulating housing protrude toward each other to form two facing locking projections at rear, the actuator defines two locking troughs matching with the respective locking projections, the locking projections buckle into the corresponding locking troughs when the actuator is closed.

* * * * *